US006187063B1

(12) United States Patent
Gunnerman

(10) Patent No.: US 6,187,063 B1
(45) **Date of Patent: *Feb. 13, 2001**

(54) AQUEOUS EMULSION FUELS FROM PETROLEUM RESIDUUM-BASED FUEL OILS

(76) Inventor: Rudolf W. Gunnerman, 6601 Lakeside Dr., Reno, NV (US) 89511

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/081,867

(22) Filed: May 20, 1998

Related U.S. Application Data

(63) Continuation-in-part of application No. 09/064,678, filed on Apr. 22, 1998, now abandoned.

(51) Int. Cl.[7] ..... C10L 1/22; C10L 1/24

(52) U.S. Cl. ..... 44/301; 44/302; 44/403; 44/399; 44/434; 44/443

(58) Field of Search ..... 44/301, 302, 399, 44/434, 403, 443

(56) References Cited

U.S. PATENT DOCUMENTS

| | | | | |
|---|---|---|---|---|
| 3,006,142 | * | 10/1961 | Carr | 44/302 |
| 3,958,915 | | 5/1976 | H. Noda et al. | 431/9 |
| 4,400,177 | * | 8/1983 | Cottell | 44/301 |
| 4,732,576 | * | 3/1988 | Friedrich et al. | 44/302 |
| 4,877,414 | * | 10/1989 | Mekonen | 44/301 |
| 4,943,390 | | 7/1990 | M.E. Hayes et al | 252/255 |
| 5,000,757 | * | 3/1991 | Puttock et al. | 44/301 |
| 5,078,064 | | 1/1992 | B. P. Breen et al. | 110/212 |
| 5,156,652 | * | 10/1992 | Gregoli et al. | 44/302 |
| 5,283,001 | * | 2/1994 | Gregoli et al. | 44/302 |
| 5,284,492 | * | 2/1994 | Dubin | 44/302 |
| 5,360,458 | * | 11/1994 | Forsberg et al. | 44/302 |
| 5,437,693 | * | 8/1995 | Iizuka et al. | 44/302 |
| 5,503,772 | | 4/1996 | H. Rivas et al. | 252/314 |
| 5,505,876 | * | 4/1996 | Rivas | 44/301 |
| 5,743,922 | * | 4/1998 | Peter-Hoblyn et al. | 44/302 |

* cited by examiner

*Primary Examiner*—Margaret Medley
(74) *Attorney, Agent, or Firm*—Townsend and Townsend and Crew LLP

(57) ABSTRACT

An aqueous macroemulsion to be used in place of petroleum residuum-based fuel oils such as No. 4, No. 5, and No. 6 fuel oils, as well as the vacuum residuum from the fraction distillation of petroleum, is formed by emulsifying the fuel oil with water or an aqueous liquid, the fuel oil forming the dispersed phase and the aqueous liquid forming the continuous phase. An emulsion stabilizer, and optionally various other additives, notably a lower allyl alcohol, are included to stabilize the properties of the emulsion. The emulsion is prepared by heating the fuel oil, particularly No. 6 fuel oil, and the water to a temperature above about 60° C., and combining the two heated liquids in an appropriate ratio and shearing the mixture to form the macroemulsion. The macroemulsion offers numerous advantages over the fuel oil itself including the fact that it can be pumped at ambient temperature rather than requiring heating, and that it is a clean-burning fuel with significantly lower emission of $NO_x$ and other pollutants and contaminants.

60 Claims, 11 Drawing Sheets

AQUEOUS EMULSION FUELS FROM PETROLEUM RESIDUUM-BASED FUEL OILS

CROSS REFERENCE TO RELATED APPLICATION

This application is a continuation-in-part of application Ser. No. 09/064,678, filed Apr. 22, 1998, now abandoned the entire contents of which are incorporated herein by reference for all legal purposes to be served thereby.

BACKGROUND OF THE INVENTION

1. Field of the Invention

This invention relates to liquid fuels known variously as bunker fuels and residual fuels, and to substitutes for these fuels that offer the advantages of lower viscosity and cleaner burning.

2. Background of the Invention

Bunker fuels are heavy residual oils used as fuel by ships and industry, and in large-scale heating installations. The fuel oil known as No. 6 fuel oil, which is also known as "Bunker C" fuel oil, is used in oil-fired power plants as the major fuel and is also used as a main propulsion fuel by deep draft vessels in the shipping industry. The fuel oils known as No. 4 and No. 5 fuel oils are used in commercial applications such as schools, apartment buildings, and other large buildings, and for large stationary and marine engines. The heaviest fuel oil is the vacuum residuum from the fractional distillation, commonly referred to as "vacuum resid," with a boiling point of 565° C. and above. Vacuum resid is primarily used as asphalt and coker feed.

The viscosity of the numbered fuel oils increases with the numerical designation. Fuel oil Nos. 4, 5, and 6 thus have higher viscosities and specific gravities than Nos. 1, 2 and 3, and vacuum resid has the highest. Because of their high viscosity, both vacuum resid and the higher numbered fuel oils generally require heating before they can be pumped. Of the numbered fuel oils, No. 6 fuel oil has the highest specific gravity (typically 0.9861 at 15/15° C.) and the highest viscosity (typically 36,000 cSt at 37.8° C.). Pumping of No. 6 fuel oil requires preheating heating to about 165° F. (74° C.), which adds considerably to the cost of its use and to the capital cost of the installation. Fuel oil Nos. 4 and 5 have a similar problem, although the heating requirement is less. In addition, both the vacuum resid and the numbered fuel oils have high sulfur contents (among the numbered fuel oils, No. 6 fuel oil having the highest sulfur content) and, like many petroleum fuels, their use entails a risk of high $NO_x$ emissions and high particle emissions.

SUMMARY OF THE INVENTION

It has now been discovered that residuum-based fuel oils such as vacuum resid, visbroken vacuum resid, liquefied coke, and fuel oil Nos. 4, 5, and 6 can be converted into low-viscosity, clean-burning liquid fuels by combining the oil with an aqueous liquid to form a macroemulsion, and incorporating sufficient emulsion stabilizer(s) to stabilize the emulsion. The resulting fuel emulsion is useful as a substitute for the non-emulsified fuel oil. For example, the emulsion prepared from No. 6 fuel oil can be used in any furnace, boiler, engine, combustion turbine or power plant where No. 6 fuel oil has heretofore been known for use. Also, the emulsion prepared from vacuum resid, visbroken vacuum resid, or liquefied coke can be used as a substitute for No. 6 fuel oil or lower-numbered fuel oils. For any of the numbered fuel oils, the viscosity of the resulting emulsion is low enough to permit pumping of the emulsion at ambient temperature, which is particularly valuable for emulsions formed with No. 6 fuel oil. Furthermore, the burning of the emulsion offers significant reductions in $NO_x$ and particulates relative to the non-emulsified fuel oil. This reduces the need and cost of exhaust gas treatment. There is also a significant reduction in the amount of soot generated, which reduces maintenance and, in boilers, improves heat transfer efficiency. In diesel engines and combustion engines, the emulsion prolongs the useful life of the lubricating oil. In general, the fuel component of the emulsion undergoes a more complete combustion which leads to improvements in fuel efficiency and thermal efficiency. In addition, the ability of the oil to be pumped at ambient temperatures lowers maintenance costs and capital costs since it eliminates the need for heated or lined transport vessels and pipelines. Emulsions prepared from vacuum resid or visbroken vacuum resid offer the further advantage of having the characteristics of the numbered fuel oils without requiring blending of the resid with a cutter stock (i.e., a distillate fraction). This provides a cheaper alternative to the numbered fuel oils.

Further features, options, advantages and embodiments of the invention will be apparent from the description that follows.

DETAILED DESCRIPTION OF THE INVENTION AND PREFERRED EMBODIMENTS

Figure 1:
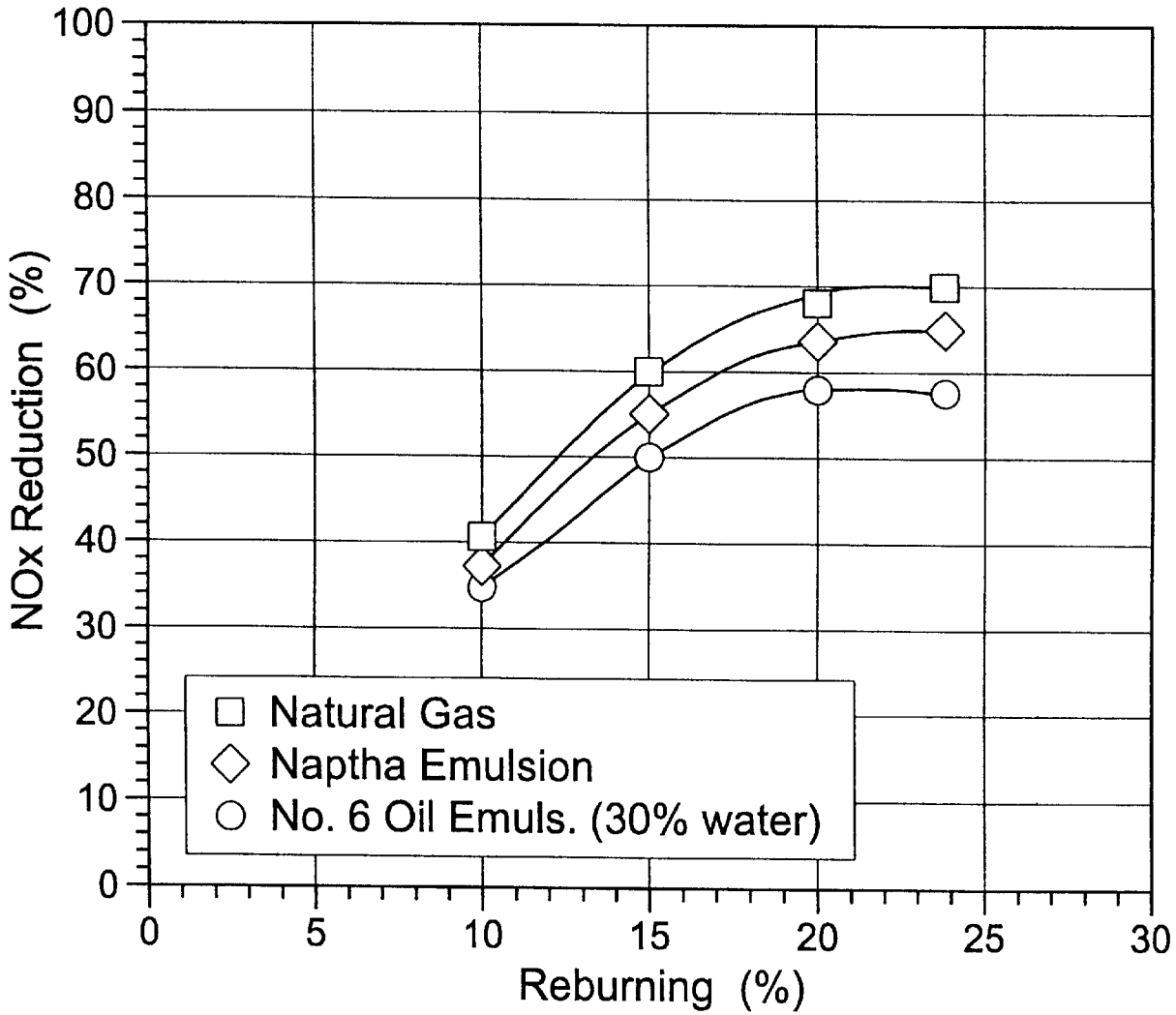
FIG. 1 is a plot of $NO_x$ reduction by reburning in a boiler as a function of the proportion of heat input supplied by the reburning stage, for three different reburning fuels, one of which is within the scope of this invention. The $NO_x$ concentration prior to the reburning stage was 450 ppm.

The residuum-based fuel oils used in this invention are products of the fractional distillation of petroleum at 410 K (390° F.) or higher. The residuum from the distillation is black and viscous with a boiling temperature in the range of 565° C. and higher, and the numbered fuel oils are blends of the residuum and one or more distillate fractions. The residuum is termed "vacuum residuum" or "vacuum resid" since it is the residue remaining after the removal of the vacuum gas oil fraction, which is the highest boiling distillate fraction. Visbroken residuum, also known as "visbreaker pitch" is vacuum residuum that has been heated to reduce its viscosity by thermal cracking. Liquefied coke is achieved by heating coke to a temperature of about 300° F. (150° C.) or higher, at which temperature coke becomes liquid. Nos. 4 and 5 fuel oils are residuum diluted with 20% to 50% distillate, while no. 6 fuel is residuum diluted with 5% to 20% distillate (all by volume). The requirements for these fuel oils, according to ASTM D 396-92, and their approximate nominal analyses (in weight percents) are as follows:

TABLE I

No. 4, No. 5, and No. 6 Fuel Oils

| | No. 4 | No. 5 | No. 6 |
|---|---|---|---|
| Minimum flash point, °C. | 55 | 55 | 60 |
| Maximum water and sediment content, vol. % | 0.50 | 1.00 | 2.00 |
| Kinematic viscosity range at 40° C., $mm^2/s$ | 1.9–2.5 (light)<br>5.5–24.0 (heavy) | | |
| Kinematic viscosity range at 100° C., $mm^2/s$ | | 5.0–8.9 (light)<br>9.0–14.9 (heavy) | 15.0–19.0 |
| Elemental Analyses: | | | |
| Carbon | 86.47 | 87.26 | 84.67 |
| Hydrogen | 1.65 | 10.49 | 11.02 |
| Oxygen | 0.27 | 0.64 | 0.38 |
| Nitrogen | 0.24 | 0.28 | 0.18 |
| Sulfur | 1.35 | 0.84 | 3.97 |
| Ash | 0.02 | 0.04 | 0.02 |
| C/H ratio | 7.42 | 8.31 | 7.62 |

This invention has utility in connection with vacuum resid, visbroken vacuum resid, liquefied coke, and blends of these materials with one or more petroleum distillate fractions. Blends of particular interest are No. 4, No. 5, and No. 6 fuel oils, preferred blends are No. 5 and No. 6 fuel oils, and the most preferred is No. 6 fuel oil.

The term "aqueous liquid" is used herein to denote the continuous phase of the emulsion and consists of water or a homogeneous liquid that is substantially insoluble in the fuel oil and contains water as its major component (i.e., greater than 50% by weight or volume, preferably greater than 90%, and most preferably greater than 95%). Since preferred emulsions of this invention as noted below contain additives, some or all of which are miscible with or soluble in water, the aqueous liquid is preferably an aqueous solution of these additives.

The emulsion is a macroemulsion, which term is used according to its recognized meaning among those skilled in emulsion technology, and denotes an emulsion in which the dispersed phase droplets are of a size that is large enough to provide the emulsion with a milky or cloudy appearance rather than a clear appearance. Otherwise stated, a macroemulsion is one whose dispersed phase droplets are of a size that if the dispersed and continuous phases alone were colorless clear liquids, the emulsion itself would be milky or cloudy. This is distinguishable from a microemulsion, in which the droplets are small enough to give the emulsion the appearance of a homogeneous single liquid phase. The macroemulsion of this invention is one in which the dispersed phase is the fuel oil and the continuous phase is the aqueous liquid. The droplet size can be controlled to some extent by physical shearing, using conventional shearing pumps or similar mixing equipment. The droplet size can also be controlled by the selection and amounts of additives such as surface active agents to stabilize the emulsion.

The relative amounts of dispersed and continuous phases can vary while still falling within the scope of the invention. In certain embodiments of the invention, the dispersed phase will generally constitute from about 50% to about 85% by volume of the macroemulsion, preferably from about 55% to about 80% by volume, more preferably from about 60% to about 75% by volume, and most preferably from about 65% to about 70% by volume. In other embodiments of the invention, the dispersed phase will constitute from about 30% to about 50% by volume of the macroemulsion.

The emulsion stabilizer can be an emulsifying agent or a mixture of emulsifying agents. The choice of emulsifying agent(s) is not critical to this invention; a wide variety of emulsifying agents, including anionic, cationic and nonionic agents, can be used. Nonionic emulsifiers are preferred. Preferred classes of nonionic emulsifiers are alkyl ethoxylates, ethoxylated alkylphenols and alkyl glucosides. One example of a nonionic emulsifier is IGEPAL CO-630 (nonylphenoxypoly(ethyleneoxy)ethanol; nonoxynol-8), available from Rhone-Poulenc, Cranbury, New Jersey, USA. Another is TERGITOL® NP-9 (α-(4-nonylphenyl)-ω-hydroxypoly(oxy-1,2-ethanediyl), available from Union Carbide Corporation, Danbury, Conn., USA). Examples of amphoteric emulsifiers are any of the various products bearing the trade name MIRATAINE®, which are betaine derivatives, also available from Rhone-Poulenc. Combinations of IGEPAL CO-630 and MIRATAINE are particularly effective in some cases.

In further preferred embodiments of this invention, the emulsifying agent can be one of a mixture of additives, other components of the mixture being agents that serve a variety of functions, such as for example increasing lubricity, heat stabilization, foam control or prevention, and rust control or prevention. Lubricity enhancers are well known, and any of the known variety can be used. Prominent examples are dicarboxylic acids such as DIACID 1525, 1550 and 1575, available from Westvaco Chemical Division, Charleston Heights, S.C., USA. Heat stabilizers are similarly well known. Included among these are amphoteric surfactants such as betaine derivatives and tallow glycinate. Examples of commercially available products of these materials are those bearing the name REWOTERIC, such as REWOTERIC AM TEG, available from Witco Corporation, New York, N.Y., USA. Antifoam agents are likewise well known, examples of which are the sulfates of long-chain alcohols, specific examples of which are the products sold under the trade name RHODAPON (RHODAPON OS, RHODAPON OLS, RHODAPON SB, RHODAPON SM, RHODAPON TDS, RHODAPON UB, and RHODAPON TEA) by Rhone-Poulenc, Inc., Monmouth Junction, N.J., USA. Antirust agents are likewise well known. Examples are AMP-95 (2-amino-2-methyl-1-propanol, available from Angus Chemical Co., Buffalo Grove, Ill., USA) and SYNKAD® 828 (borate or carboxylate salts, available from Ferro Corporation, Keil Chemical Division, Hammond, Ind., USA). For macroemulsions formed from No. 6 fuel oil, an additive mixture that contains both AMP-95 and SYNKAD 828 is particularly effective in maintaining a stable emulsion.

In many cases, the formation of the emulsion can be facilitated by the incorporation of a mixing aid. Any of the wide variety of additives known for their ability to serve as mixing aids can be used. Preferred mixing aids in the present invention are alcohols, particularly saturated alkyl alcohols. Prominent among these are $C_1$–$C_4$ saturated alkyl alcohols, and of these the $C_1$–$C_3$ saturated alkyl alcohols are more preferred. Particularly preferred examples are methanol and ethanol. The amount of alcohol used is not critical; any amount that will enhance the mixing of the fuel oil and the aqueous liquid can be used. This amount may vary depending on the proportions of the two liquid phases and on the selection and amounts of other additives present. In most cases, an amount of alcohol within the range of from about 0.3% to about 10% by volume of the macroemulsion will provide the best results, preferably from about 0.5% to about 5% by volume, and most preferably from about 1% to about 4% by volume. The remaining additives, i.e., the emulsifying agent, lubricity additive, heat stabilizer, antifoam agent, and rust inhibitor (whether all or some of these are included) may vary in amounts as well, the effects of varying the amounts being generally known to those skilled in the use of these additives. In most cases, the total of these additives other than the alcohol will range from about 0.05% to about 5% by volume of the macroemulsion, preferably from about 0.1% to about 3% by volume, and most preferably from about 0.1% to about 1% by volume.

In the case of No. 6 fuel oil, the macroemulsion of this invention is prepared by heating No. 6 fuel oil and water (or aqueous liquid) separately, mixing the two liquids thus heated, and shearing the mixture to achieve the droplet dispersion that constitutes the macroemulsion. The temperatures to which the two separate phases are heated can vary, generally between about 60° C. and about 95° C. (140° F.–203° F.), preferably between about 62° C. and about 90° C. (144° F.–194° F.), and more preferably between about 65° C. and about 85° C. (149° F.–185° F.), and most preferably between about 67° C. and about 75° C. (153° F.–167° F.). The temperatures to which the two phases are individually heated prior to mixing will be within about 10° C. of each other (18° F.), preferably within about 5° C. of each other (9° F.), and most preferably will be substantially the same.

In the case of vacuum resid and similar materials, the emulsion can be formed by adding the water in the form of superheated steam or pressurized water or steam at a temperature high enough that the residuum is liquid. In the case of vacuum resid, a preferred temperature for the steam or water is about 205° C. (400° F.) or higher, preferably from about 205° C. to about 300° C. In the case of liquefied coke, a preferred temperature for the steam or water is about 150° C. (300° F.) or higher, preferably from about 150° C. to about 250° C. If pressurized water or steam is used, best results will be obtained with pressures in the range of from about 30 psi to about 150 psi. At pressures toward the upper end of this range, the need for a shear pump is avoided.

The emulsion stabilizing additives are preferably added before the shearing step. The alcohol, when included, is likewise preferably added before the shearing step. Shearing is accomplished by conventional means, utilizing any of the various types of mixing and shearing equipment known in the chemical process industry. Examples are fluid foil impellers, axial-flow turbines, flat-blade turbines, jet mixers, and the like. The shear pressure may vary, although best results are obtained with a shear pressure within the range of from about 100 psi to about 200 psi, with about 150 psi preferred. Once the shearing is complete, the resulting macroemulsion can be cooled to ambient temperature (10° C.–40° C., or 50° F.–104° F.) while still remaining of sufficiently low viscosity to be pumped.

The macroemulsion fuel of this invention is useful in a wide variety of heat generation units, including boilers and furnaces of various types. In general, the macroemulsion can be used in applications where the nonaqueous fuel oil itself is otherwise used, with the macroemulsion serving as a substitute for the fuel oil. Examples of ways in which the macroemulsion can be used are (1) as a total replacement for the nonaqueous fuel oil in applications in which the fuel oil has heretofore been used, (2) as a fuel in combination with other fuels that are not oils, notably coal, and (3) as a reburner fuel for boilers and furnaces.

Reburning is a means of controlling $NO_x$ emissions in boilers and furnaces, and involves injecting a portion of the fuel downstream of the main burners (i.e., the primary combustion zone) to cause further combustion of the primary combustion product in a fuel-rich reducing zone. While natural gas has been employed in most reburning operations in the prior art, the present invention provides the use of the macroemulsions disclosed herein as the reburning fuel. The primary fuel can be any of a variety of fuels, including natural gas, coal, and fuel oils. In preferred reburning operations, additional air ("overfire air") is injected downstream of the injection point of the reburning fuel. The overfire air serves to oxidize any carbon monoxide or other combustibles that are generated in the reburn zone.

The amount of reburning fuel injected relative to the fuel fed to the primary combustion zone is conveniently expressed in terms of the heat content of the fuel. The heat content itself may be expressed as a percentage of the total heat content of both the reburn fuel and the primary fuel. While the relative amounts are not critical to this invention, the efficiency of the macroemulsion in lowering the $NO_x$ concentration of the flue gas will vary with the amount of heat input supplied by the macroemulsion. In most cases, best results will be obtained when the macroemulsion supplies from about 15% to about 30% of the total heat input to the unit, preferably from about 18% to about 24%, and most preferably about 20%.

The efficiency of the reburn stage may also vary with the $NO_x$ concentration of the combustion product leaving the primary combustion stage, although again this is not critical to this invention. The $NO_x$ concentration of the combustion product will vary with the type of boiler or furnace and the type of primary fuel used. In general, however, best results in terms of $NO_x$ reduction will be obtained with a primary combustion stage product mixture containing from about 100 to about 3,000 ppm by weight of $NO_x$, and preferably from about 250 to about 1,000 ppm by weight of $NO_x$.

Reburning can affect the performance of a boiler or furnace in terms of the thermal efficiency of the unit and, in the case of boilers, the steam temperature. The water in the macroemulsions of this invention will add to the latent heat loss in the unit. Thus, when macroemulsions of the present invention are used as reburning fuels, the quantity of fuel needed to achieve a given reduction in $NO_x$ can be expected to be greater in view of the need to compensate for the increased heat loss. The amount of increase required will be readily apparent to those skilled in the art.

The following examples are offered only as illustration and are not intended to impose any limits on the scope of this invention.

EXAMPLE 1

A No. 6 fuel oil with heating value of 18,236 Btu/lb (9,019 calories/gram) was obtained. The analysis of the oil was 0.65% water, 85.40% carbon, 10.47% hydrogen, 0.56% nitrogen, 1.53% sulfur, 0.04% ash, and 1.35% oxygen (by difference) (all percents by weight). An additive mixture was prepared by combining 14 parts by volume of TERGITOL NP-9 surfactant, 2 parts by volume DIACID 1525 lubricity additive, and 1 part by volume of REWOTERIC AM TEG heat stabilizer.

The fuel oil and water were heated separately to about 160° F. (71° C.), and 67.55 parts by volume of the heated fuel oil were mixed with 30 parts by volume of the heated water. Added to these were 0.45 parts by volume of the additive mixture described in the preceding paragraph, 2 parts by volume of ethanol, and 2 ppm by volume of RHODAPON TEA antifoam. Shearing was performed on a shear pump with 140 psi shear, although higher shears can be used and may be preferable.

The resulting macroemulsion had a specific gravity (60/60° F., 15/15° C.) of 0.9923, a heating value of 105,767 Btu/gal, a kinematic viscosity (40° C.) of 18.37 cSt, and a flash point of 185° F. (85° C.), and was readily pumpable at ambient temperature (20–25° C.).

EXAMPLE 2

This example illustrates the use of a No. 6 fuel oil emulsion of this invention as a reburn fuel in a natural gas-fired boiler.

The tests were performed in a 1.0 MM Btulh boiler simulation facility that was designed to provide an accurate subscale simulation of the furnace gas temperatures, residence times, and composition of a full scale utility boiler. The facility consisted of a burner, a vertically down-fired radiant furnace, a horizontal convective pass, and a baghouse. A variable swirl diffusion burner with an axial fuel injector was used to simulate the temperature and gas composition of a commercial burner in a full scale boiler. Primary air was injected axially, while the secondary air stream was injected radially through the swirl vanes to provide controlled fuel/air mixing. The swirl number was controlled by adjusting the swirl vanes. Numerous ports located along the axis of the facility allowed supplementary equipment such as reburn/overfire air injectors, sampling probes, and suction pyrometers to be placed in the furnace. The cylindrical furnace section of the facility was constructed of eight modular refractory-lined sections with an inside diameter of 22 inches. The convective pass was also refractory lined, and contained air-cooled tube bundles to simulate the superheater and reheater sections of a full scale utility boiler.

The flame in the facility was typically 3–4 feet long. For reburning tests, the reburn fuel was injected just downstream of the flame to establish a reducing zone. Overfire air was injected in the lower part of the furnace at 2,300° F. (1,260° C.) to oxidize CO and any residual combustibles generated in the reburn zone. Residence time in the reburn zone was 0.5 second except where otherwise noted.

The initial $NO_x$ concentration was controlled by metering gaseous ammonia into the primary combustion air. This provided close control over furnace $NO_x$ levels. Stoichiometric ratios of air to fuel were set at three locations—the primary burn zone (i.e., the air/fuel mixture fed to the main burners), the secondary burn zone (the reburn zone immediately after injection of the reburn fuel), and the final burn zone (after injection of the overfire air). The term "SR1" is used to indicate the stoichiometric ratio in the primary burn zone, "SR2" the ratio in the secondary burn zone, and "SRf" the ratio in the final burn zone. The value of SR1 used in the tests was 1.10 and the value of SRf was 1.15. The total firing rate in all tests in this series was 840,000 Btu/h.

Natural gas was used as the main fuel for all tests in this example. The fuels used for reburning included natural gas, a naphtha/water emulsion with 30% water, and two No. 6 fuel oil emulsions, one containing 30% water and the other containing 40% water (all by volume). Each emulsion was stabilized by an additive mixture formed by combining 15 liters of NONYLPHENOL 9MOL surfactant (nonylphenol +9 EO polyethoxylate), 2 liters of REWOTERIC AM TEG (dihydroxyethyl tallow glycinate), 2 liters of DIACID 1550 (a $C_{21}$ dicarboxylic acid), 2 liters of AMP 95 (2-amino-2-methyl-1-propanol), 4 liters of SYNKAD 828 (a carboxylic acid salt), 1–¾ oz. of RHODAPON TEA (triethanolamine lauryl sulfate), and 10 liters of methanol. The proportion of additive mixture to the total emulsion was approximately 0.9% by volume. Table II summarizes analyses for the naphtha and No. 6 oil emulsions with 30% water.

TABLE II

| Component | Naphtha Emulsion (weight %) | No. 6 Oil Emulsion (weight %) |
|---|---|---|
| C | 58.59 | 60.17 |
| H | 10.00 | 7.38 |
| N | 0.35 | 7.39 |
| S | 0.00 | 1.08 |
| Ash | 0.00 | 0.03 |
| O | 1.06 | 0.95 |
| $H_2O$ | 30.00 | 30.00 |
| Total | 100.00 | 100.00 |
| Heating Value (Btu/lb as fired) | 13,709 | 12,849 |

It was determined that all emulsions, including those made with No. 6 oil, could be pumped and atomized without the need to preheat above the ambient temperature of approximately 65° F. (18° C.). For injection as reburn fuel, the emulsions were pumped using a progressive cavity pump and atomized using a twin-fluid atomizer with nitrogen as the atomization medium. The reburn injector was elbow-shaped and was installed along the centerline of the furnace, countercurrent to the gas flow.

Flue gases were analyzed by a continuous emissions monitoring system, which included a water-cooled sample probe, a sample conditioning system (to remove water and particulates), and gas analyzers. The analyses included $O_2$ by paramagnetism (0.1% precision), $NO_x$ by chemiluminescence (1 ppm precision), CO by nondispersive infrared spectroscopy (1 ppm precision), and $CO_2$ by nondispersive infrared spectroscopy (0.1% precision).

FIG. 1 shows a performance comparison of the different reburn fuels (natural gas represented by squares, naphtha emulsion by diamonds, and No. 6 fuel oil emulsion with 30% water by circles) as a function of reburn heat input (expressed as a percentage of the total heat input into the boiler) at an initial $NO_x$ concentration of 450 ppm. For each fuel, $NO_x$ control progressively increased as reburn heat input was increased from 10 to 20%, and then levelled off as reburn heat input was further increased to 24%. Natural gas provided the highest $NO_x$ control, followed by the naphtha emulsion and the No. 6 oil emulsion with 30% water. At initial $NO_x$=450 ppm, the highest $NO_x$ control provided by natural gas was 70%, as compared to 59% by No. 6 oil emulsion.

Effect of Initial $NO_x$ Concentration on Performance

Figure 2:
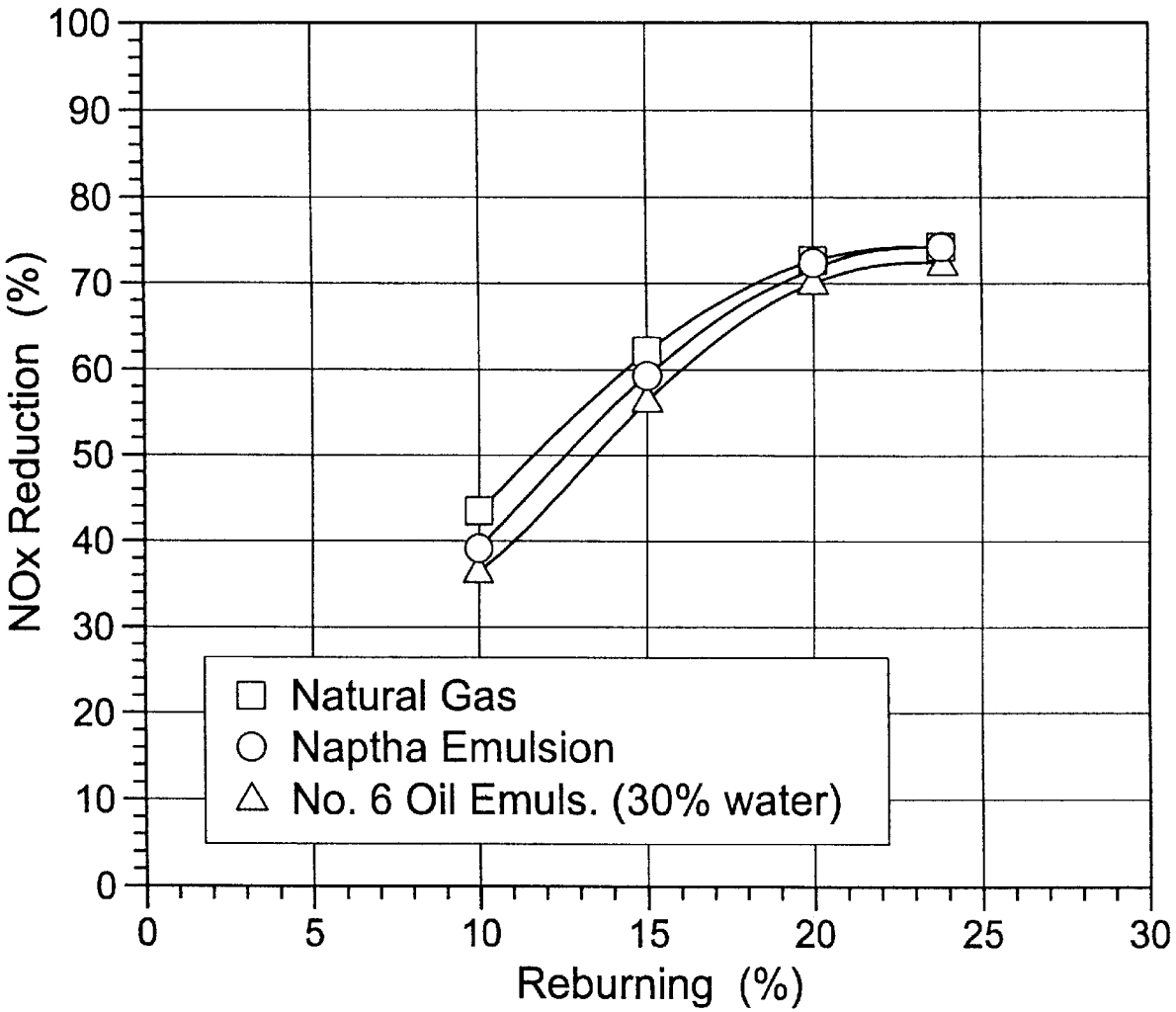
FIG. 2 is a plot similar to that of FIG. 1 except that the $NO_x$ concentration prior to the reburning stage was 800 ppm.

When the initial $NO_x$ was increased to 800 ppm, the performance variation among the different reburn fuels was much less than at an initial $NO_x$ concentration of 450 ppm. FIG. 2 compares reburn performance of natural gas (represented by squares), the naphtha emulsion (circles), and the No. 6 fuel oil emulsion (triangles) at an initial $NO_x$ concentration of 800 ppm. At reburn heat inputs of 20% or higher, similar $NO_x$ reductions were obtained with each reburn fuel. At 24% reburn heat input, each of the three reburn fuels provided between 72 and 73% $NO_x$ control.

Figure 3:
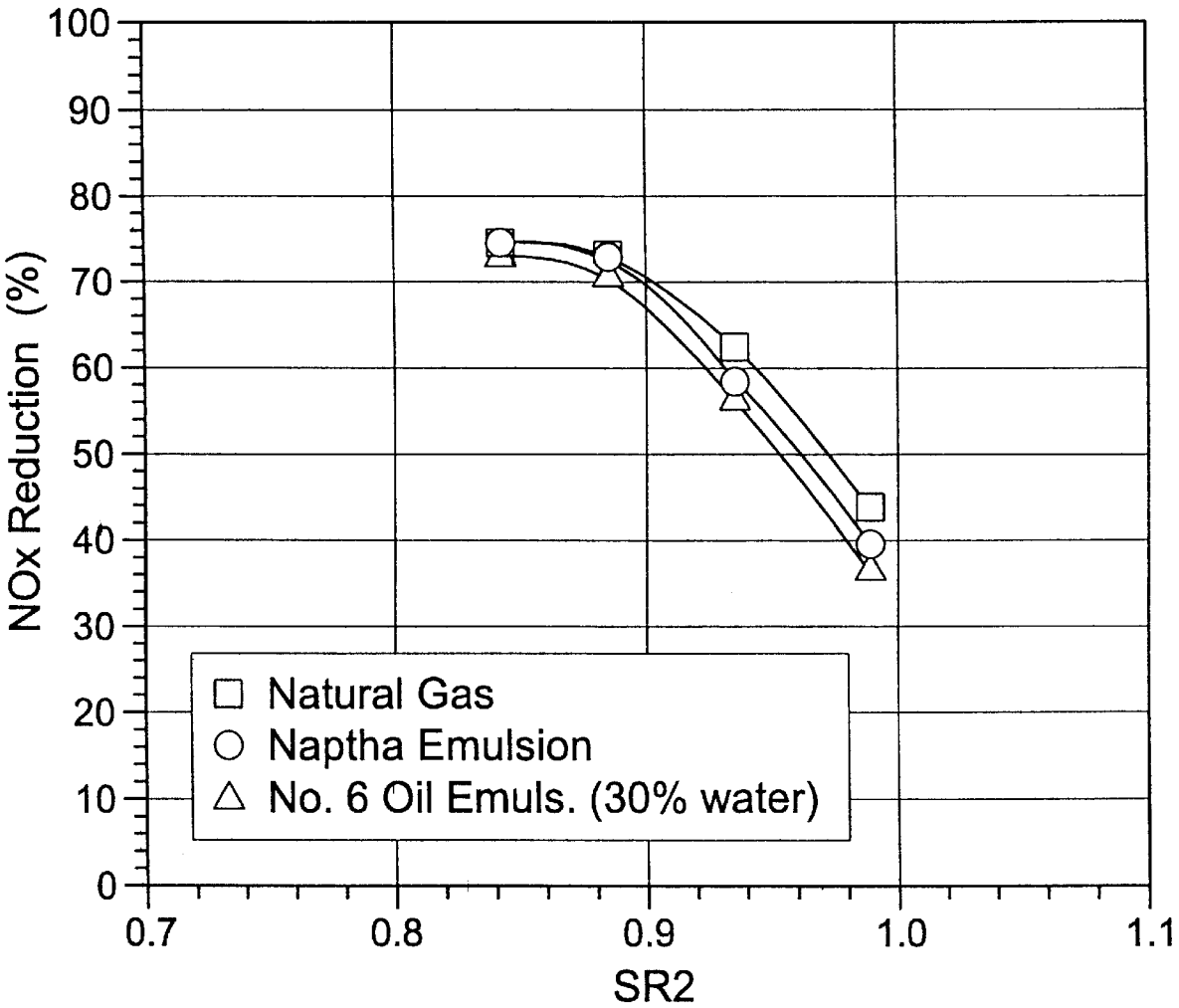
FIG. 3 is a plot of $NO_x$ reduction in a reburning stage as a function of stoichiometric (air-to-fuel) ratio immediately downstream of the injection point of the reburn fuel, which is a macroemulsion within the scope of this invention.

FIG. 3 presents the same comparison as a function of reburn zone stoichiometry (natural gas represented by squares, naphtha emulsion by circles, and No. 6 fuel oil emulsion by triangles). At SR2 values below 0.9, $NO_x$ reductions were approximately insensitive to SR2 and were similar for each test fuel.

Figure 4:
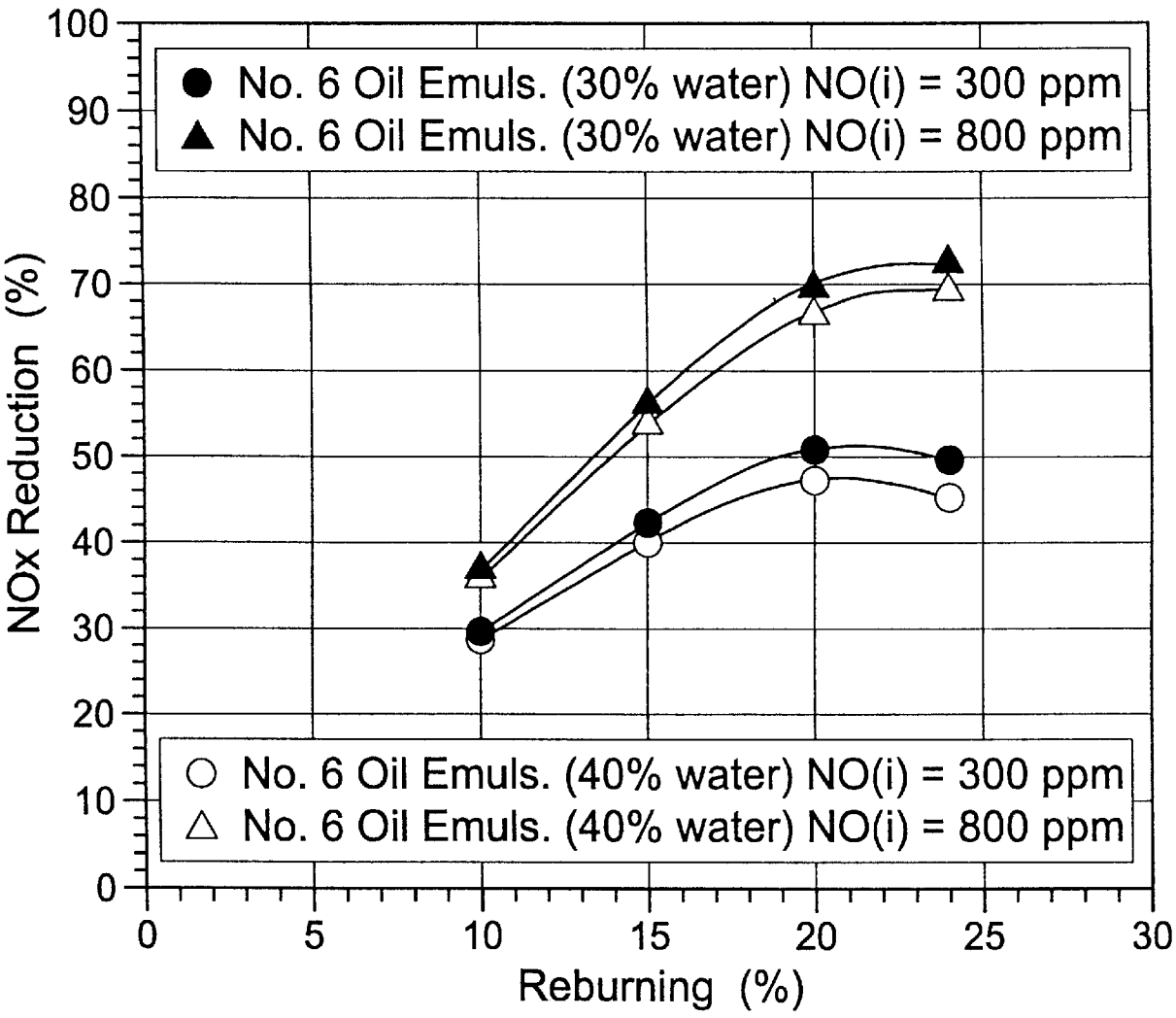
FIG. 4 is a plot of $NO_x$ reduction in a reburning stage as a function of the proportion of heat input supplied by the reburning stage, for two different macroemulsions within the scope of this invention, at two different $NO_x$ concentrations prior to the reburning stage.

FIG. 4 presents a reburn performance comparison between the No. 6 fuel oil emulsion containing 30% water (filled circles and triangles) and the No. 6 fuel oil emulsion containing 40% water (open circles and triangles), each at initial $NO_x$ concentrations of 300 ppm (circles) and 800 ppm (triangles). At each initial $NO_x$ concentration, $NO_x$ reduction was higher by 1 to 4 percentage points for the emulsion with 30% water as compared to the emulsion with 40% water.

Figure 5:
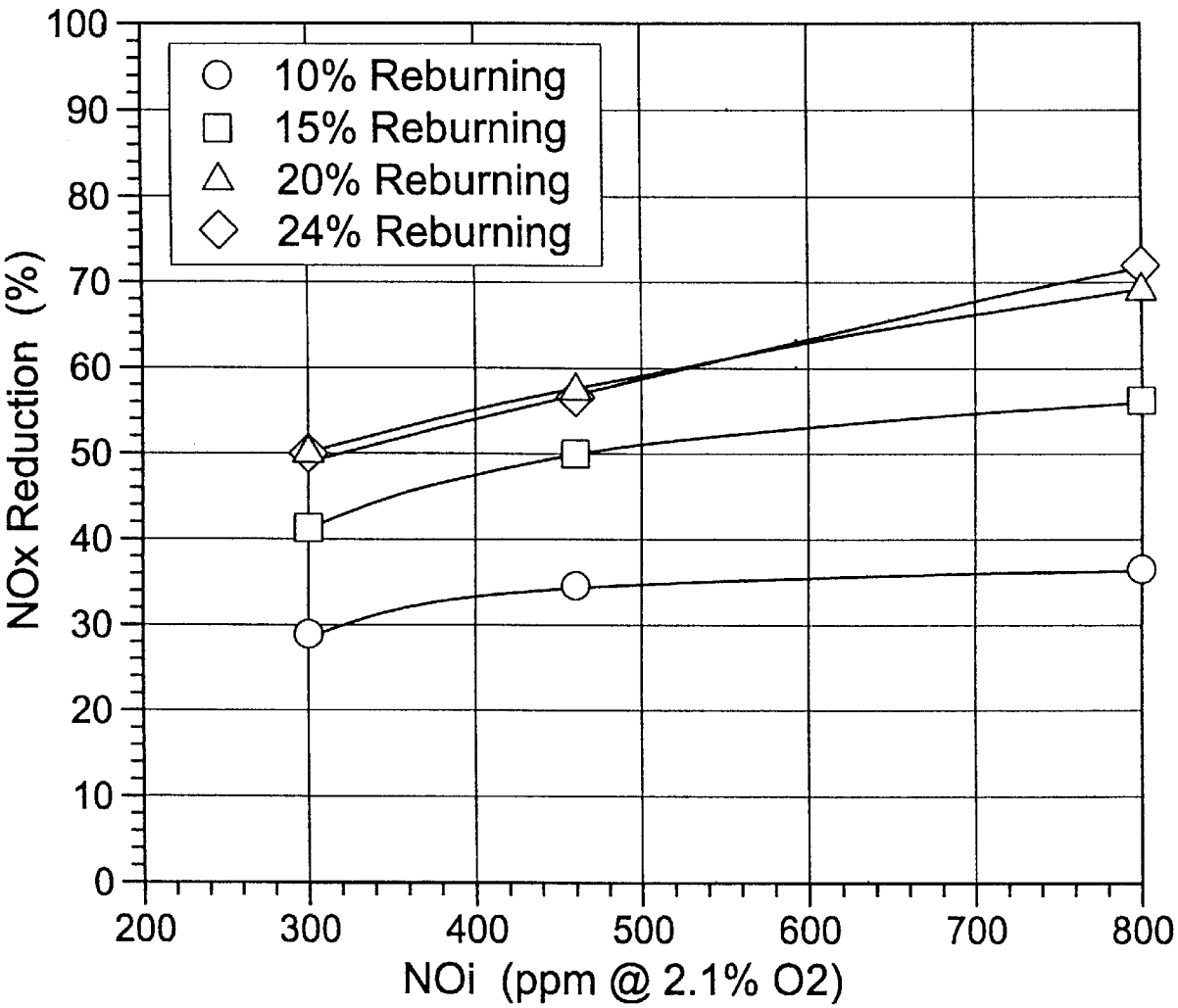
FIG. 5 is a plot of $NO_x$ reduction in a reburning stage as a function of the $NO_x$ concentration entering the reburning stage, at four different levels of the proportion of heat input supplied by the reburning stage.
Figure 6:
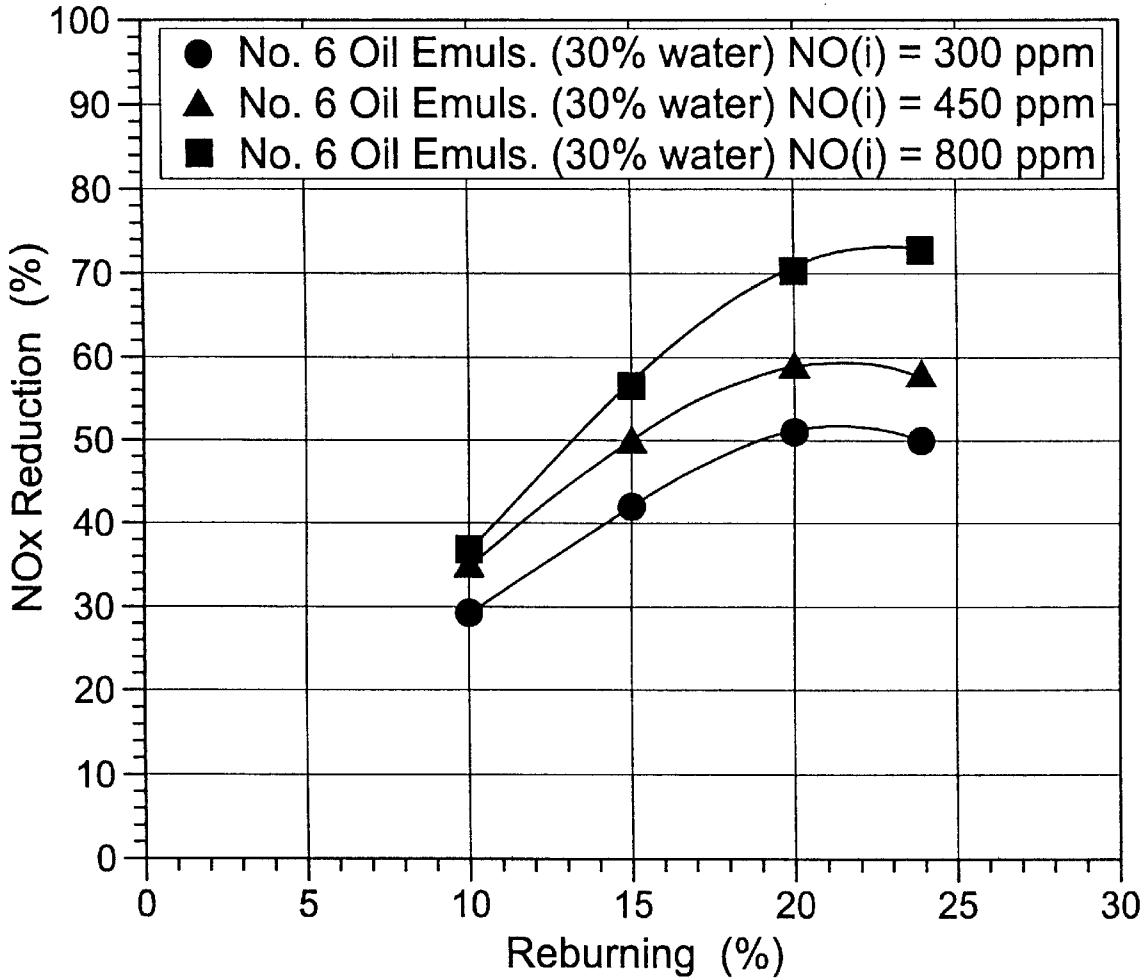
FIG. 6 is a plot of $NO_x$ reduction in a reburning stage as a function of the proportion of heat input supplied by the reburning stage, at three different levels of $NO_x$ concentration entering the reburning stage.

The $NO_x$ concentration in the combustion gas produced by the main burners in a boiler can vary with composition of the fuel to the burners, the boiler design, the flame zone temperature, and the type of burner used. The effectiveness of reburning generally decreases as initial $NO_x$ concentration decreases; this is due to kinetic limitations in the reburning reactions. For this reason, reburn tests using emulsions in accordance with the present invention were conducted at initial $NO_x$ concentrations of 300, 450, and 800 ppm. FIG. 5 shows the performance of the fuel oil No. 6 emulsion (with 30% water) as a function of initial $NO_x$ concentration. Tests with 10% reburning are represented by circles; tests with 15% reburning are represented by squares; tests with 20% reburning are represented by diamonds; and tests with 24% reburning are represented by diamonds. $NO_x$ reduction increases significantly with increasing initial $NO_x$ concentration. At 20% reburning, $NO_x$ reduction increased from 50% when the initial $NO_x$ concentration was 300 ppm to 70% when the initial $NO_x$ concentration was 800 ppm. FIG. 6 presents this data as a function of reburn heat input (expressed as percentage of the total heat input) for the three different initial $NO_x$ concentrations—300 ppm represented by circles; 450 ppm represented by triangles; and 800 ppm represented by squares. The performance curve is much steeper at the initial $NO_x$ concentration of 800 ppm than at initial $NO_x$ concentration of 300 ppm. At 10% reburning the performance difference between initial $NO_x$ concentration values of 300 and 800 ppm is only 8 percentage points, while at 24% reburning the difference is 22 percentage points. This indicates that No. 6 oil emulsion reburning is particularly effective in boilers with high initial $NO_x$ concentrations.

Effect of Reburn Zone Residence Time on Performance

To cause reburning to occur, overfire air must be injected in the reburn zone either upstream of the banks of convective tubes or in between the banks. The location of the overfire air injectors determines the residence time in the reburn zone, and in full scale boilers, the location of these injectors is subject to spatial limitations in the boiler design. Reburn $NO_x$ control generally increases with increasing reburn zone residence time.

Figure 7:
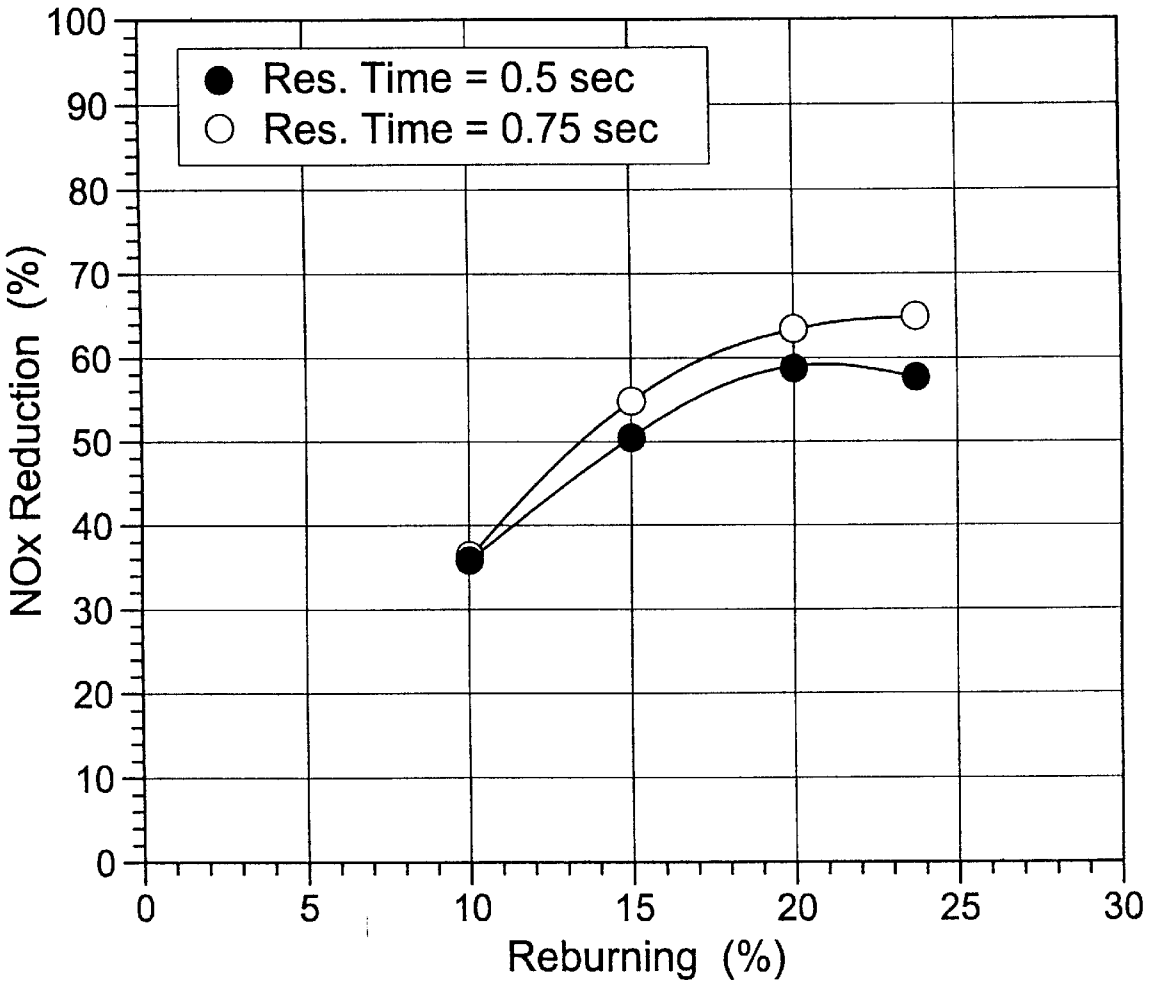
FIG. 7 is a plot of $NO_x$ reduction in a reburning stage as a function of the proportion of heat input supplied by the reburning stage, at two different residence times in the reburning stage.

To determine the effect of reburn zone residence time on $NO_x$ reduction, experiments were performed at residence times of 0.50 and 0.75 sec. FIG. 7 shows the reburn performance of the fuel oil No. 6 emulsion (with 30% water) at these residence times (0.5 sec represented by filled circles, and 0.75 sec represented by open circles) with initial $NO_x$= 450 ppm. The $NO_x$ reduction increases with increasing residence time, and the impact of residence time on $NO_x$ reduction increases with increasing reburn heat input. At 24% reburning, $NO_x$ reduction was 65% at 0.75 sec residence time, as compared to 58% at 0.50 sec.

EXAMPLE 3

This example illustrates the use of a No. 6 fuel oil emulsion of this invention as a reburn fuel in a pulverized coal-fired boiler (i.e., a boiler using pulverized coal as its main fuel), and in a cyclone fired boiler. The pulverized coal-fired boiler had a baseline $NO_x$ concentration of 0.38 lbm/MMBtu (=300 ppm). The cyclone fired boiler had a baseline $NO_x$ concentration of 1.0 lbm/MMBtu (=800 ppm).

Figure 8:
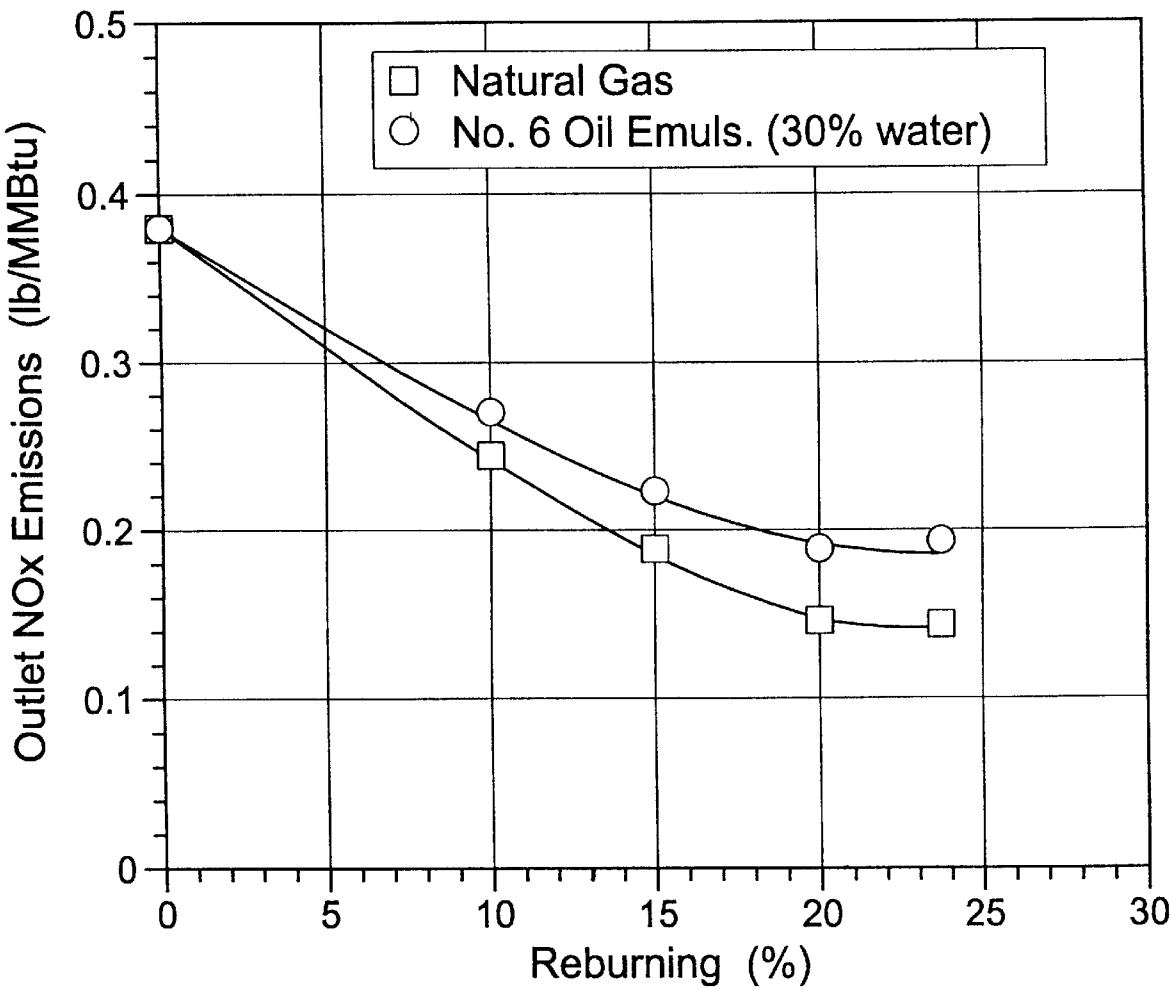
FIG. 8 is a plot of $NO_x$ reduction in a reburning stage as a function of the proportion of heat input supplied by the reburning stage, at a $NO_x$ concentration of 0.38 lb/MMBtu entering the reburning stage, for two different reburn fuels, one of which is within the scope of the invention.

The pulverized coal-fired boiler was simulated by a boiler whose main fuel was natural gas but whose initial $NO_x$ concentration was 0.38 lbm/MMBtu. Using the No. 6 fuel oil emulsion (30% water) as the reburn fuel, $NO_x$ emissions decreased from 0.38 lb/MMBtu with no reburning to 0.18 lb/MMBtu at 20% reburning, as shown in FIG. 8 (circles). FIG. 8 also shows the results obtained with natural gas as the reburn fuel (squares).

Figure 9:
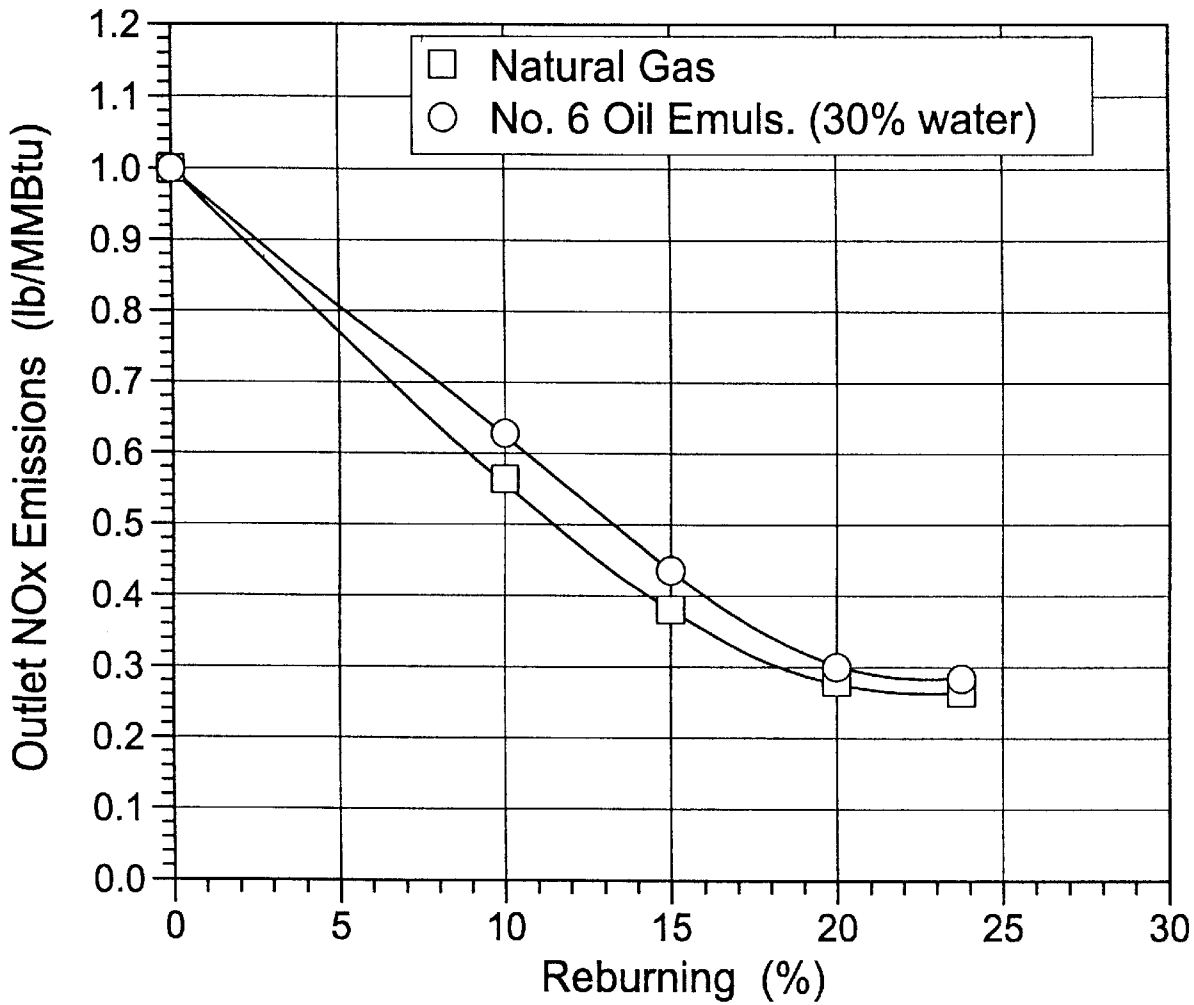
FIG. 9 is a plot of $NO_x$ reduction in a reburning stage as a function of the proportion of heat input supplied by the reburning stage, at a $NO_x$ concentration of 1.0 lb/MMBtu entering the reburning stage, for two different reburn fuels, one of which is within the scope of the invention.

The cyclone fired boiler was simulated a boiler whose main fuel was natural gas but whose initial $NO_x$ concentration was 1.0 lbm/MMBtu. Using the No. 6 fuel oil emulsion (30% water) as the reburn fuel, $NO_x$ emissions decreased from 1.0 lb/MMBtu with no reburning to 0.27 lb/MMBtu at 24% reburning, as shown in FIG. 9 (circles). FIG. 8 also shows the results obtained with natural gas as the reburn fuel (squares).

EXAMPLE 4

This example illustrates the use of a No. 6 fuel oil emulsion of this invention as the primary combustion fuel in a boiler, comparing these results to those obtained using No. 6 fuel oil itself (in the absence of water and not emulsified).

The boiler was a three-pass firetube "Scotch" marine-type boiler whose burner was rated at $2.5\times10^6$ Btu/h with a ring-type natural gas burner and an air-atomizing center nozzle oil burner. The boiler had 300 square feet of heating surface and was capable of generating up to 2,400 lb/h saturated steam at pressures up to 15 psig. The boiler was equipped with instrumentation for continuous emission monitoring for various emissions including $NO_x$, using a Rosemount Analytical Model 951A $NO_x$ analyzer operating by chemiluminescence and accurate to 0.5% of full scale. Particulate matter in the flue gas was measured in a sampling train by conventional techniques, with three samples taken per test condition. The No. 6 fuel oil and No. 6 fuel oil emulsion used were those described in Example 2 above, the emulsion containing 30% water.

Figure 10:
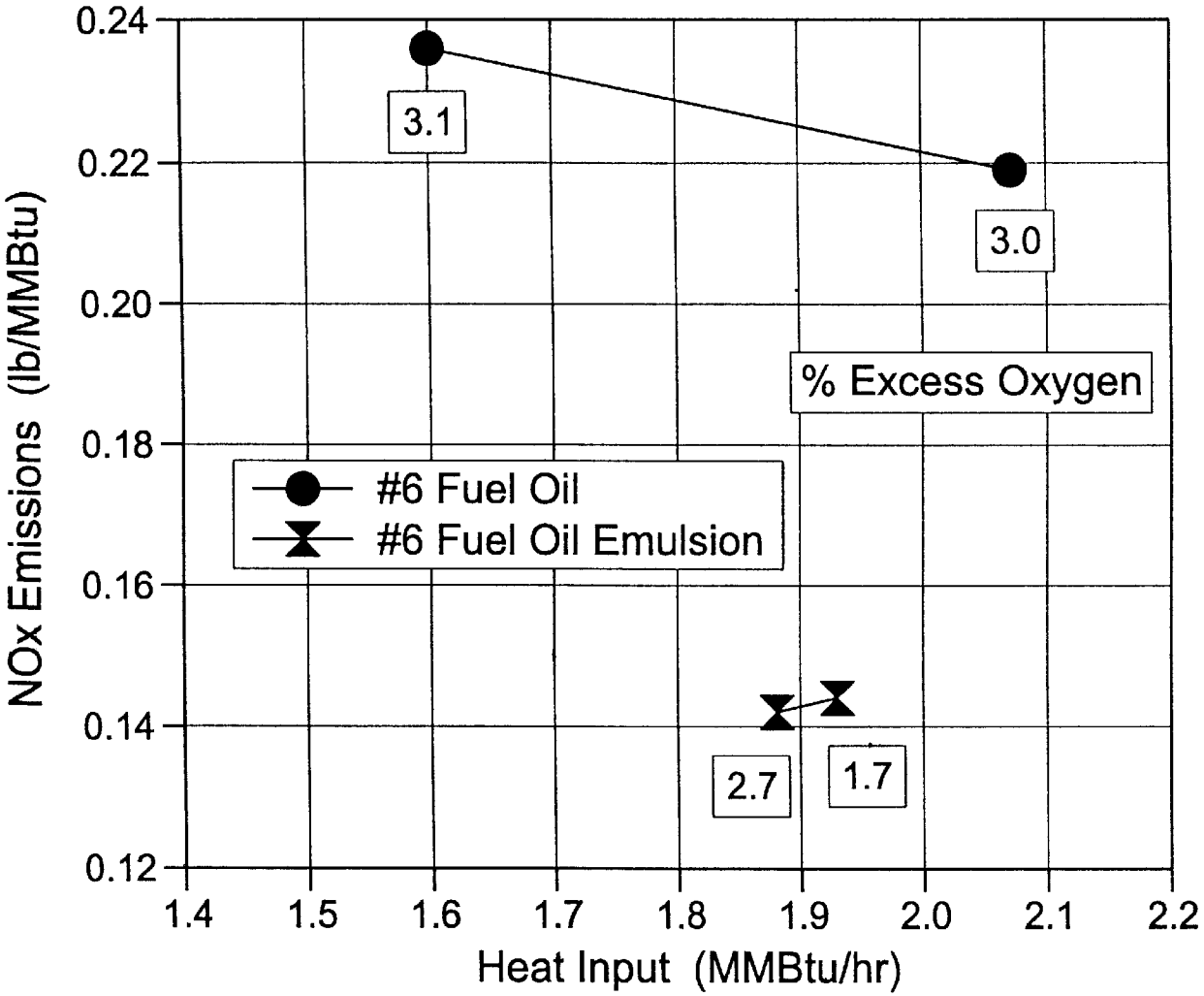
FIG. 10 is a plot of $NO_x$ emissions from a boiler as a function of heat input to the boiler, comparing a boiler where the primary combustion fuel was straight No. 6 fuel oil with one where the primary combustion fuel was a No. 6 fuel oil emulsion.

The test results included a comparison of $NO_x$ emissions as a function of heat input to the boiler, for both straight No. 6 fuel oil and the No. 6 fuel oil emulsion. These results are plotted in FIG. 10, which shows that the $NO_x$ emissions were reduced by amounts within the range of 24% to 40% by replacing the straight No. 6 fuel oil (filled circles) with the emulsion (X's). With the straight fuel oil, the $NO_x$ emissions were 0.237 lb/MMBtu at a heat input of 1.60 MMBtu/h, and 0.220 lb/MMBtu at a heat input of 2.07 MMBtu/h. For the emulsion, the $NO_x$ emissions were 0.142 lb/MMBtu at a heat input of 1.88 MMBtu/h, and 0.143 lb/MMBtu at a heat input of 1.93 MMBtu/h.

Figure 11:
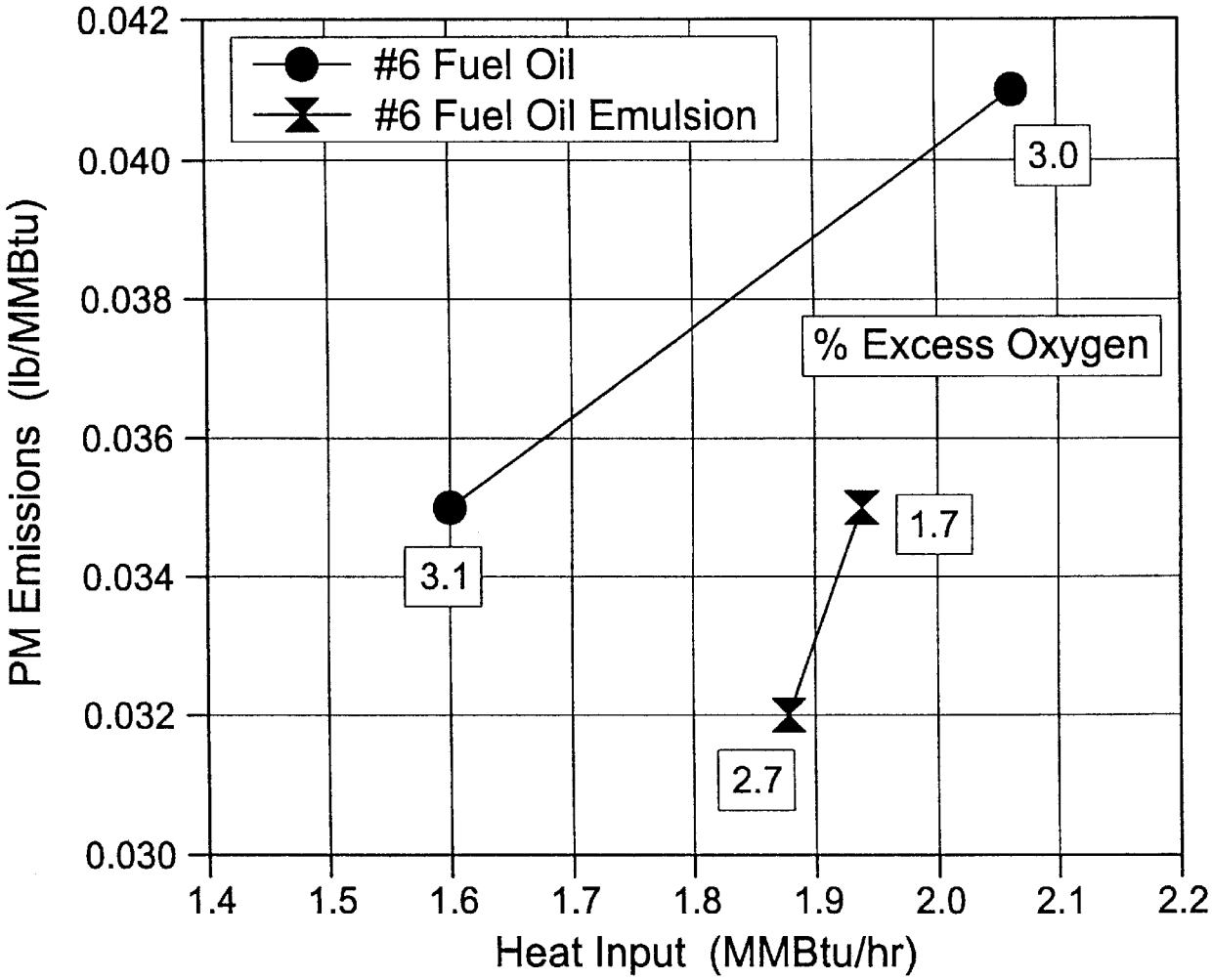
FIG. 11 is a plot of particulate emissions from a boiler as a function of heat input to the boiler, comparing a boiler where the primary combustion fuel was straight No. 6 fuel oil with one where the primary combustion fuel was a No. 6 fuel oil emulsion.

The particulate matter emissions are plotted in FIG. 11 as a function of heat input to the boiler. These results likewise show a substantial reduction due to the replacement of the straight No. 6 fuel oil (filled circles) with the emulsion (X's). Using the straight fuel oil, the particulate emissions rose from 0.035 lb/MMBtu at a heat input of 1.61 MMBtu/h to 0.041 lb/MMBtu at a heat input of 2.06 MMBtu/h, whereas with the emulsion, the particulate emissions rose from 0.032 lb/MMBtu at a heat input of 1.88 MMBtu/h to 0.035 lb/MMBtu at a heat input of 1.93 MMBtu/h.

The foregoing is offered primarily for purposes of illustration. It will be readily apparent to those skilled in the art that further variations and modifications beyond those discussed herein can be made without departing from the spirit and scope of the invention.

I claim:

1. A macroemulsion useful as a low-viscosity, clean-burning liquid fuel, said macroemulsion comprising:

(i) a dispersed phase of a petroleum-derived fuel oil selected from the group consisting of a residuum from fractional distillation of crude petroleum, a visbroken residuum, liquefied coke, and residua blended with a distillate fraction, (ii) a continuous phase of an aqueous liquid, (iii) a nonylphenol polyethoxylate emulsion stabilizing additive in an amount effective in stabilizing said emulsion, (iv) a dicarboxylic acid lubricity enhancer in an amount effective in enhancing lubricity, and (v) a dihydroxyethyl tallow glycinate heat stabilizer in an amount effective in heat stabilizing said macroemulsion, said dispersed phase constituting from about 50% to about 85% by volume of said macroemulsion.

2. A macroemulsion in accordance with claim 1 in which said petroleum-derived fuel oil is a member selected from the group consisting of vacuum residuum from fractional distillation of crude petroleum, a visbroken vacuum residuum, No. 4 fuel oil, No. 5 fuel oil and No. 6 fuel oil.

3. A macroemulsion in accordance with claim 1 in which said dispersed phase constitutes from about 55% to about 80% by volume of said macroemulsion.

4. A macroemulsion in accordance with claim 1 in which said dispersed phase constitutes from about 60% to about 80% by volume of said macroemulsion.

5. A macroemulsion in accordance with claim 1 in which said dispersed phase constitutes from about 65% to about 70% of said macroemulsion.

6. A macroemulsion in accordance with claim 1 in which said petroleum-derived fuel oil is a member selected from the group consisting of No. 4 fuel oil, No. 5 fuel oil and No. 6 fuel oil.

7. A macroemulsion in accordance with claim 6 in which said petroleum-derived fuel oil is a member selected from the group consisting of No. 5 fuel oil and No. 6 fuel oil.

8. A macroemulsion in accordance with claim 6 in which said petroleum-derived fuel oil is No. 6 fuel oil.

9. A macroemulsion in accordance with claim 1 in which said macroemulsion further comprises an alcohol in an amount effective in enhancing mixing of said petroleum-derived fuel oil and said aqueous liquid.

10. A method for the preparation of a low-viscosity, clean-burning fuel based on liquefied coke, said method comprising combining said liquefied coke with an aqueous fluid at a temperature of at least about 150° C. and emulsifying said liquefied coke and aqueous fluid in the presence of a nonylphenol polyethoxylate emulsion stabilizing additive, a dicarboxylic acid lubricity enhancer, and a dihydroxyethyl tallow glycinate heat stabilizer, to form a macroemulsion in which said liquefied coke forms a dispersed phase and said aqueous fluid forms a continuous phase.

11. A macroemulsion in accordance with claim 9 in which said alcohol is a $C_1$–$C_4$ saturated alkyl alcohol.

12. A macroemulsion in accordance with claim 9 in which said alcohol is a $C_1$–$C_3$ saturated alkyl alcohol.

13. A macroemulsion in accordance with claim 9 in which said alcohol is a member selected from the group consisting of methanol and ethanol.

14. A macroemulsion in accordance with claim 9 in which said alcohol is from about 0.3% to about 10% by volume of said macroemulsion.

15. A macroemulsion in accordance with claim 9 in which said alcohol is from about 0.5% to about 5% by volume of said macroemulsion.

16. A macroemulsion in accordance with claim 9 in which said alcohol is from about 1% to about 4% by volume of said macroemulsion.

17. A macroemulsion in accordance with claim 1 in which said petroleum-derived fuel oil is No. 6 fuel oil and said emulsion stabilizing additive comprises a combination of 2-amino-2-methyl-1-propanol, a salt of a carboxylic acid, and a surfactant.

18. A method for the preparation of a low-viscosity, clean-burning liquid fuel based on No. 6 fuel oil, said method comprising:

(a) heating No. 6 fuel oil to a temperature of from about 60° C. to about 95° C.;

(b) separately heating an aqueous liquid to a temperature within about 10° C. of the temperature to which said No. 6 fuel oil is heated;

(c) combining said fuel oil and said aqueous liquid thus heated, at a volumetric ratio of from about 50:50 to about 85:15 (fuel oil:aqueous liquid); and (d) shearing said combined fuel oil and aqueous liquid in the presence of an emulsion stabilizing additive to form a macroemulsion in which said fuel oil forms a dispersed phase and said aqueous liquid forms a continuous phase.

19. A method in accordance with claim 18 further comprising cooling said macroemulsion to a temperature of from about 10° C. to about 40° C.

20. A method in accordance with claim 18 further comprising cooling said macroemulsion to a temperature of from about 15° C. to about 30° C.

21. A method in accordance with claim 18 in which said temperature of (a) is from about 62° C. to about 90° C.

22. A method in accordance with claim 18 in which said temperature of (a) is from about 65° C. to about 85° C.

23. A method in accordance with claim 18 in which said temperature of (a) is from about 67° C. to about 75° C.

24. A method in accordance with claim 18 in which said temperature of (b) is within about 5° C. of the temperature to which said No. 6 fuel oil is heated.

25. A method in accordance with claim 18 in which said temperature of (b) is substantially equal to the temperature to which said No. 6 fuel oil is heated.

26. A method in accordance with claim 18 in which said emulsion stabilizing additive is combined with said fuel oil and said aqueous liquid in step (c).

27. A method in accordance with claim 18 further comprising combining an alcohol with said fuel oil and said aqueous liquid prior to step (d).

28. A method in accordance with claim 18 further comprising combining said emulsion stabilizing additive and an alcohol with said fuel oil and said aqueous liquid prior to step (d).

29. A method in accordance with claim 10 in which said aqueous fluid is supersaturated steam.

30. A method in accordance with claim 27 in which said alcohol is a $C_1$–$C_3$ saturated alkyl alcohol.

31. A method in accordance with claim 27 in which said alcohol is a member selected from the group consisting of methanol and ethanol.

32. A method in accordance with claim 27 in which said alcohol constitutes from about 0.3% to about 10% by volume of the total of said fuel oil and said aqueous liquid.

33. A method in accordance with claim 27 in which said alcohol constitutes from about 0.5% to about 5% by volume of the total of said fuel oil and said aqueous liquid.

34. A method in accordance with claim 27 in which said alcohol constitutes from about 1% to about 4% by volume of the total of said fuel oil and said aqueous liquid.

35. In a method for controlling $NO_x$ emissions from a fuel-fired heat generation unit selected from the group consisting of boilers and furnaces in which a first portion of fuel is combusted in a main burner thereby forming a combustion product stream and a second portion of fuel is injected into said combustion product stream to cause reburning of said combustion product mixture in a reducing atmosphere, the improvement in which said second portion of fuel is a low-viscosity, clean-burning macroemulsion comprising:

(i) a dispersed phase of a petroleum-based fuel oil selected from the group consisting of a residuum from fractional distillation of crude petroleum, a visbroken residuum, liquefied coke, and residua blended with a distillate fraction, (ii) a continuous phase of an aqueous fluid, (iii) a nonylphenol polyethoxylate emulsion stabilizing additive in an amount effective in stabilizing said emulsion, (iv) a dicarboxylic acid lubricity enhancer in an amount effective in enhancing lubricity, and (v) a dihydroxyethyl tallow glycinate heat stabilizer in an amount effective in heat stabilizing said macroemulsion, said dispersed phase constituting from about 50% to about 85% by volume of said macroemulsion.

36. A method in accordance with claim 35 in which said petroleum-based fuel oil is a member selected from the group consisting of vacuum residuum from fractional distillation of crude petroleum, a visbroken vacuum residuum, No. 4 fuel oil, No. 5 fuel oil and No. 6 fuel oil.

37. A method in accordance with claim 35 in which said dispersed phase constitutes from about 55% to about 80% of said macroemulsion.

38. A method in accordance with claim 35 in which said dispersed phase constitutes from about 60% to about 75% of said macroemulsion.

39. A method in accordance with claim 35 in which said dispersed phase constitutes from about 65% to about 70% of said macroemulsion.

40. A method in accordance with claim 35 in which said petroleum-based fuel oil is a member selected from the group consisting of No. 4 fuel oil, No. 5 fuel oil and No. 6 fuel oil.

41. A method in accordance with claim 40 in which said petroleum-based fuel oil is a member selected from the group consisting of No. 5 fuel oil and No. 6 fuel oil.

42. A method in accordance with claim 40 in which said petroleum-based fuel oil is 6 fuel oil.

43. A method in accordance with claim 40 in which said macroemulsion further comprises an alcohol in an amount effective in enhancing mixing of said petroleum-based fuel oil and said aqueous liquid.

44. A method in accordance with claim 40 in which said aqueous liquid is a solution of said emulsion stabilizing additive and an alcohol in water.

45. A method in accordance with claim 10 in which said aqueous fluid is pressurized water.

46. A method in accordance with claim 44 in which said alcohol is a $C_1$–$C_3$ saturated alkyl alcohol.

47. A method in accordance with claim 44 in which said alcohol is a member selected from the group consisting of methanol and ethanol.

48. A method in accordance with claim 44 in which said amount of said alcohol is from about 0.3% to about 10% by volume of said macroemulsion.

49. A method in accordance with claim 44 in which said amount of said alcohol is from about 0.5% to about 5% by volume of said macroemulsion.

50. A method in accordance with claim 44 in which said amount of said alcohol is from about 1% to about 4% by volume of said macroemulsion.

51. A method in accordance with claim 40 in which said macroemulsion provides from about 15% to about 30% of the total heat value of said first and second fuel portions.

52. A method in accordance with claim 40 in which said macroemulsion provides from about 18% to about 24% of the total heat value of said first and second fuel portions.

53. A method in accordance with claim 40 in which said combustion product stream contains from about 100 to about 3,000 ppm by weight of $NO_x$.

54. A method in accordance with claim 40 in which said combustion product stream contains from about 250 to about 1,000 ppm by weight of $NO_x$.

55. A method in accordance with claim 40 in which said fuel-fired heat generation unit is a coal-fired boiler and said first portion of fuel is coal.

56. A method for the preparation of a low-viscosity, clean-burning fuel based on residuum from fractional distillation of crude petroleum, said method comprising combining said residuum with an aqueous fluid at a temperature of at least about 205° C. and emulsifying said residuum and aqueous fluid in the presence of a nonylphenol polyethoxylate emulsion stabilizing additive, a dicarboxylic acid lubricity enhancer, and a dihydroxyethyl tallow glycinate heat stabilizer, to form a macroemulsion in which said residuum forms a dispersed phase and said aqueous fluid forms a continuous phase.

57. A method in accordance with claim 56 in which said temperature is from about 205° C. to about 300° C.

58. A method in accordance with claim 56 in which said aqueous fluid is supersaturated steam.

59. A method in accordance with claim 56 in which said aqueous fluid is pressurized water.

60. A method in accordance with claim 10 in which said temperature is from about 150° C. to about 250° C.

* * * * *